US006698376B2

(12) United States Patent
Delahousse et al.

(10) Patent No.: US 6,698,376 B2
(45) Date of Patent: Mar. 2, 2004

(54) DEVICE FOR LAUNCHING AND RECOVERING AN UNDERWATER VEHICLE AND IMPLEMENTATION METHOD

(75) Inventors: Xavier Franck Yann Delahousse, La Seyne-sur-Mer (FR); David Jean-Pierre Barre, La Ciotat (FR); Andre Honor Adolphe Meirier, Sollies-ville (FR)

(73) Assignee: Societe ECA, Boulogne-Billancourt Cedex (FR)

( * ) Notice: Subject to any disclaimer, the term of this patent is extended or adjusted under 35 U.S.C. 154(b) by 0 days.

(21) Appl. No.: 10/121,854

(22) Filed: Apr. 15, 2002

(65) Prior Publication Data

US 2002/0152946 A1 Oct. 24, 2002

(30) Foreign Application Priority Data

Apr. 13, 2001 (FR) ..... 01 05085

(51) Int. Cl.[7] ..... B63G 8/41
(52) U.S. Cl. ..... 114/322; 114/51
(58) Field of Search ..... 114/312, 259, 114/44, 45, 244, 249, 253, 322, 50, 51; 414/137.7

(56) References Cited

U.S. PATENT DOCUMENTS

| | | | | | |
|---|---|---|---|---|---|
| 3,448,712 | A | * | 6/1969 | Lehmann et al. | 114/259 |
| 3,536,023 | A | | 10/1970 | Toher et al. | 114/259 |
| 3,724,410 | A | * | 4/1973 | Lok | 114/322 |
| 3,807,335 | A | * | 4/1974 | Talkington | 114/44 |
| 3,890,919 | A | * | 6/1975 | Opdahl et al. | 114/239 |
| 3,943,875 | A | * | 3/1976 | Sanders | 114/244 |
| 3,993,011 | A | * | 11/1976 | Garland | 114/210 |
| 4,010,619 | A | * | 3/1977 | Hightower et al. | 114/322 |
| 4,487,153 | A | * | 12/1984 | McMahon et al. | 114/312 |
| 6,148,759 | A | * | 11/2000 | Taylor, Jr. | 114/312 |
| 6,260,504 | B1 | * | 7/2001 | Moles et al. | 114/312 |
| 6,276,625 | B1 | * | 8/2001 | Chee et al. | 114/312 |
| 6,390,012 | B1 | * | 5/2002 | Watt et al. | 114/322 |

FOREIGN PATENT DOCUMENTS

| | | |
|---|---|---|
| GB | 2 150 903 A | 7/1985 |
| JP | 51-102900 | 9/1976 |
| WO | 00/71415 A1 | 11/2000 |

OTHER PUBLICATIONS

Wang Ditang et al., "A Launch And Recovery System For An Autonomous Underwater Vehicle Explorer". Proceedings Of The Symposium On Autonomous Underwater Vehicle Technology. Washington, Jun. 2–3, 1992, pp. 279–281.

Hanumant Singh et al., "Intelligent Docking For An Autonomous Ocean Sampling Network". Oceans '97. Halifax, Canada, Oct. 6–9, 1997. Vol. 2, pp. 1126–1131.

Patent Abstracts of Japan, vol. 1997, No. 2, Feb. 28, 1997 & JP 08 282588 A (Tech Res & AMP; Dev Inst of Japan DEF Agency; Mitsubishi Heavy Ind Ltd), Oct. 29, 1996.

* cited by examiner

*Primary Examiner*—S. Joseph Morano
*Assistant Examiner*—Larsa Olson
(74) *Attorney, Agent, or Firm*—Young & Thompson

(57) ABSTRACT

A device for launching and recovering an underwater vehicle comprises a submersible assembly comprising a lower chassis and an upper chassis, which are connected by a flexible connection so that the distance between them is adjustable. The flexible connection and the lower and upper chassis form a receiving cage provided with an opening, whose vertical dimension can be adjusted. Moving the lower and upper chassis apart makes it possible to enlarge the vertical dimension of the opening. Moving the lower and upper chassis closer together makes it possible to support the underwater vehicle on the lower chassis and hold it in place using the upper chassis.

11 Claims, 3 Drawing Sheets

DEVICE FOR LAUNCHING AND RECOVERING AN UNDERWATER VEHICLE AND IMPLEMENTATION METHOD

FIELD OF THE INVENTION

The present invention relates to a device for launching and recovering an underwater vehicle.

BACKGROUND OF THE INVENTION

The operation of submerging an underwater vehicle several meters under the surface of the sea, from a platform of a boat is made tricky by the vertical movements of the boat which are caused on the surface of the water by the swell, and are conventionally known as "heave". The vertical movements due to the swell at a depth of a few meters are attenuated but since the launch and recovery device is generally fixed to the boat by means of a cable, it is driven vertically by the boat. The relative movements of the underwater vehicle and of the launch and recovery device may cause damage to the said underwater vehicle.

Document U.S. Pat. No. 3,807,335 discloses a submerged platform intended for submerging an underwater vehicle fixed vertically under the platform which is secured to a boat by cables connected to the platform via dampers, so as to attenuate the vertical movements of the platform which are due to the vertical movements of the boat.

Nonetheless, this device for launching and recovering an underwater vehicle does not make it possible to completely get around the problem of the vertical movements, which can merely be attenuated.

SUMMARY OF THE INVENTION

The invention proposes a device for launching and recovering an underwater vehicle which makes it possible to get around the disadvantages associated with the heave.

The invention also proposes a device for launching and recovering an underwater vehicle which is suited to the storage of the underwater vehicle on a boat.

The invention finally proposes a device which allows an underwater vehicle to be launched and recovered near to its working depth.

A device for launching and recovering an underwater vehicle according to the invention comprises a submersible assembly comprising a lower chassis and an upper chassis, the lower and upper chassis being connected by a flexible connection, so that the distance between the said upper and lower chassis is adjustable to make it easier for the underwater vehicle to move in a zone lying between the lower and upper chassis.

The flexible connection and the lower and upper chassis form a receiving cage provided with an opening 28, the vertical dimension of which can be adjusted. Moving the lower and upper chassis apart makes it possible to enlarge the vertical dimension of the said opening so that the underwater vehicle can enter or leave the cage without the movements of the cage due to the heave impeding the entry or departure of the underwater vehicle. Moving the lower and upper chassis closer together in the vertical direction makes it possible, in spite of the vertical movements of the cage as a whole as a result of the heave, to support the underwater vehicle on the lower chassis and hold it in place using the upper chassis. By moving the lower and upper chassis closer together quickly enough, successive impacts between the underwater vehicle and the lower chassis are avoided.

In one embodiment, the lower and upper chassis are connected by a cable bundle, the cables of which can easily be wound onto pulleys so as to reduce the distance between the lower and upper chassis, or unwound so as to increase the distance between the lower and upper chassis.

In one embodiment, the launch and recovery device comprises means of winding up and unwinding the cables, which allows the length of the cables and therefore the separation between the lower chassis and the upper chassis to be adjusted.

In one embodiment, the device comprises at least one motor used to rotate a number of pulleys onto which the flexible connection is wound.

As a preference, the device is secured to a boat situated at the surface by at least one cable of adjustable length. Thus, the submersible assembly can be submerged to the desired depth, for example a depth close to the working depth of the underwater vehicle.

Advantageously, positioning means are arranged between the upper chassis and the lower chassis. The positioning means, in the form of stops for example, vertically limit the closeness of the lower and upper chassis so as not to damage the underwater vehicle when the said vehicle is being recovered. The positioning means guide the positioning of the lower chassis with respect to the upper chassis in a horizontal plane so as to make sure that the underwater vehicle is held correctly in the launch and recovery device.

In one embodiment, the lower chassis comprises a lower cradle for receiving the underwater vehicle. The receiving cradle makes recovering the underwater vehicle onto the lower chassis easier.

As a preference, the cradle comprises at least one receiving concave wall, the profile of which guides the underwater vehicle as contact is made between the lower chassis and the underwater vehicle while the said underwater vehicle is being recovered.

Advantageously, the cradle can be detached from the lower chassis. Thus, when the device is returned, with the underwater vehicle, to the device situated at the surface, it is possible easily to access the underwater vehicle, for example for maintenance operations, by moving away the cage formed by the launch and recovery device so as to gain access to the underwater vehicle.

In one embodiment, the upper chassis comprises an upper holding cradle, which allows the underwater vehicle to be held in place in the launch and recovery device.

The invention also relates to a method for launching and recovering an underwater vehicle, in which method a launch and recovery device comprising an upper chassis and a lower chassis is submerged, the upper and lower chassis being connected by a flexible connection, so that the distance between the said upper and lower chassis is adjustable, and in which device an underwater vehicle is placed. The distance between the upper and lower chassis is increased to release the underwater vehicle, and the distance between the upper and lower chassis is reduced for recovering the underwater vehicle once the underwater vehicle has moved into a zone lying between the lower and upper chassis.

BRIEF DESCRIPTION OF THE DRAWINGS

The present invention and its advantages will be better understood from studying the detailed description of one embodiment which is taken by way of non-limiting example and illustrated by the appended drawings, in which.

DETAILED DESCRIPTION OF THE INVENTION

Figure 1:
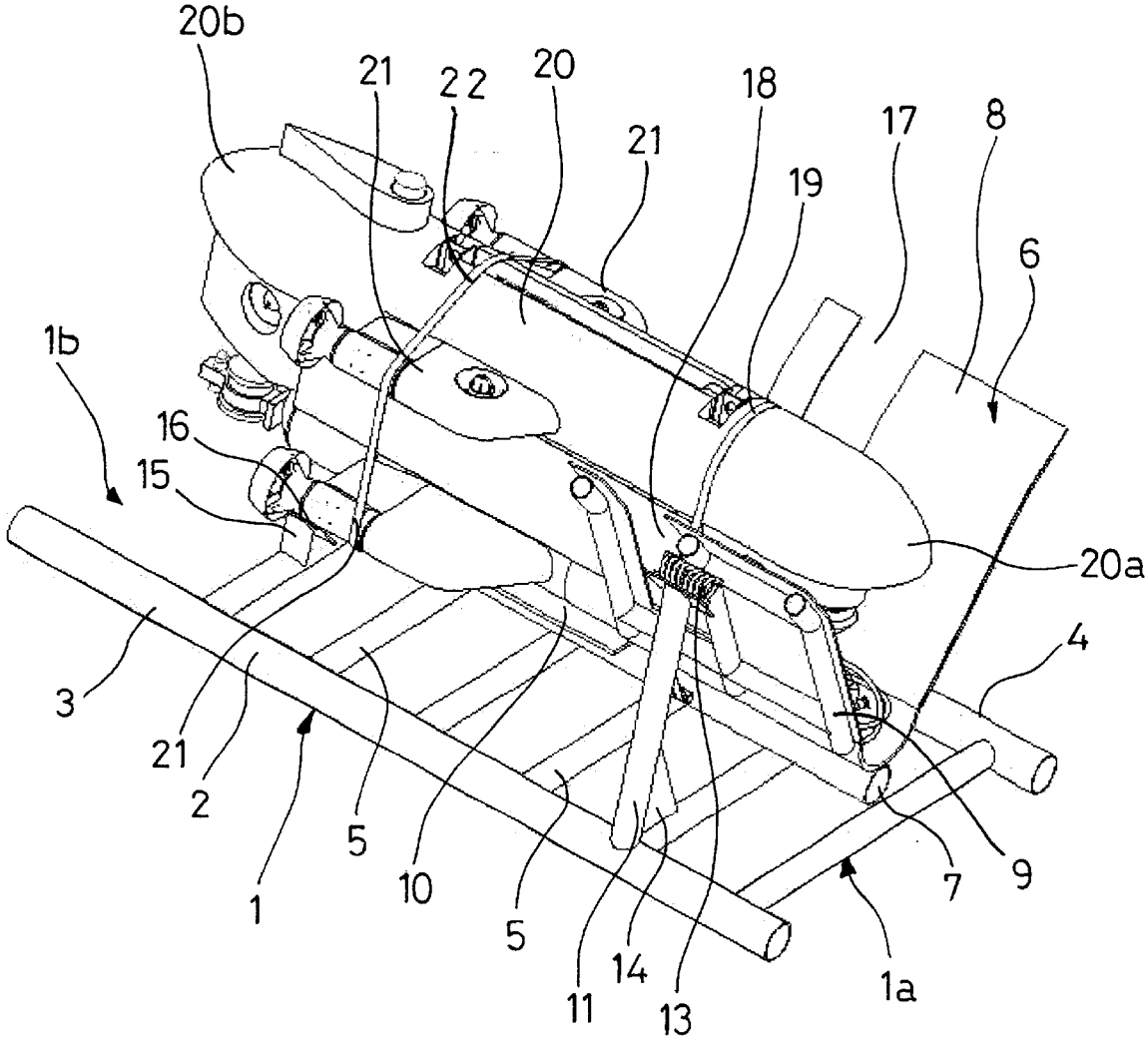
FIG. 1 is a schematic perspective view of an underwater vehicle situated on the cradle of a device according to one aspect of the invention.

In FIG. 1, a cradle 1, provided with a front part 1*a* and with a rear part 1*b*, has a tubular framework 2 comprising two longitudinal tubes 3, 4 arranged parallel to each other in a horizontal plane and connected by a number of transverse tubes 5 running at right angles to the longitudinal tubes 3, 4.

A seating surface 6 comprises a support tube 7 situated longitudinally above the transverse tubes 5, more or less mid-way between the longitudinal tubes 3, 4, and vertically some distance from the transverse tubes 5.

On the portion of the support tube 7 that is situated on the front part 1*a* of the cradle 1, the seating surface 6 comprises a wall 8 which is concave upwards and convex downwards, in the form of a metal sheet bent into a V with the opening uppermost and facing away from the framework 2, and running from the support tube 7 on each side of a vertical plane of symmetry passing through the support tube 7. The concave wall 8 runs longitudinally from a first end of the support tube 7, over a limited length of the support tube 7. The seating surface 6 comprises a tubular reinforcing structure 9 arranged under the concave wall 8 on each side of the plane of symmetry so as to reinforce the concave wall 8. On the portion of the support tube that is situated on the rear part 1*b* of the cradle 1, the seating surface 6 comprises a front bearing plate 10 running longitudinally along the support tube 7 from the zone on the concave wall 8 that is in contact with the support tube 7.

The seating surface 6 rests on the framework 2 via two similar support tubes 11, 12 arranged symmetrically with respect to the concave wall 8, both in the same transverse plane, the support tube 12 not being visible in FIG. 1. An absorption stop 13, for example made of an elastomeric material, is arranged between the upper end of the support tube 11 and an upper end of the reinforcing structure 9, to absorb impacts that may arise when recovering an underwater vehicle. The support tube 11 is arranged roughly vertically between the longitudinal tube 3 on the one hand, and the reinforcing structure 9 on the other. The support tube 11 is situated in the same transverse plane as a transverse tube 5. A reinforcement 14 in the form of a triangular plate connecting the adjacent ends of the support tube 11 and of the said transverse tube 5 stiffens the connection between the support tube 11 and the framework 2 so as to take up loads applied by the bearing plate 6 to the holding tube 11.

On the rear part 1*b* of the cradle 1, the seating surface 6 rests on the framework 2 via blocks 15 and absorption stops 16 which are similar to the absorption stop 13, and arranged on a transverse tube 5.

The concave wall 8 comprises two rectangular openings 17, 18 which run transversely more or less from the support tube 7 as far as the free ends of the concave wall 8 so as to allow a fixing strap 19 to be passed through.

An underwater vehicle referenced 20 in its entirety, running longitudinally, rests on the seating surface 6. The front 20*a* of the vehicle 20 rests on the concave wall 8, the rear 20*b* of the underwater vehicle 20 rests on the bearing plate 10. The underwater vehicle comprises a number of thrusters 21 situated at the rear of the underwater vehicle 20 to move it vertically or horizontally or cause it to turn. The fixing strap 19 holds the front 20*a* of the underwater vehicle 20 against the concave wall 8 of the seating surface 6. A strap 22 arranged transversely holds the rear 20*b* of the underwater surface 20 against the bearing plate 10, being arranged longitudinally at the thrusters 21.

Figure 2:
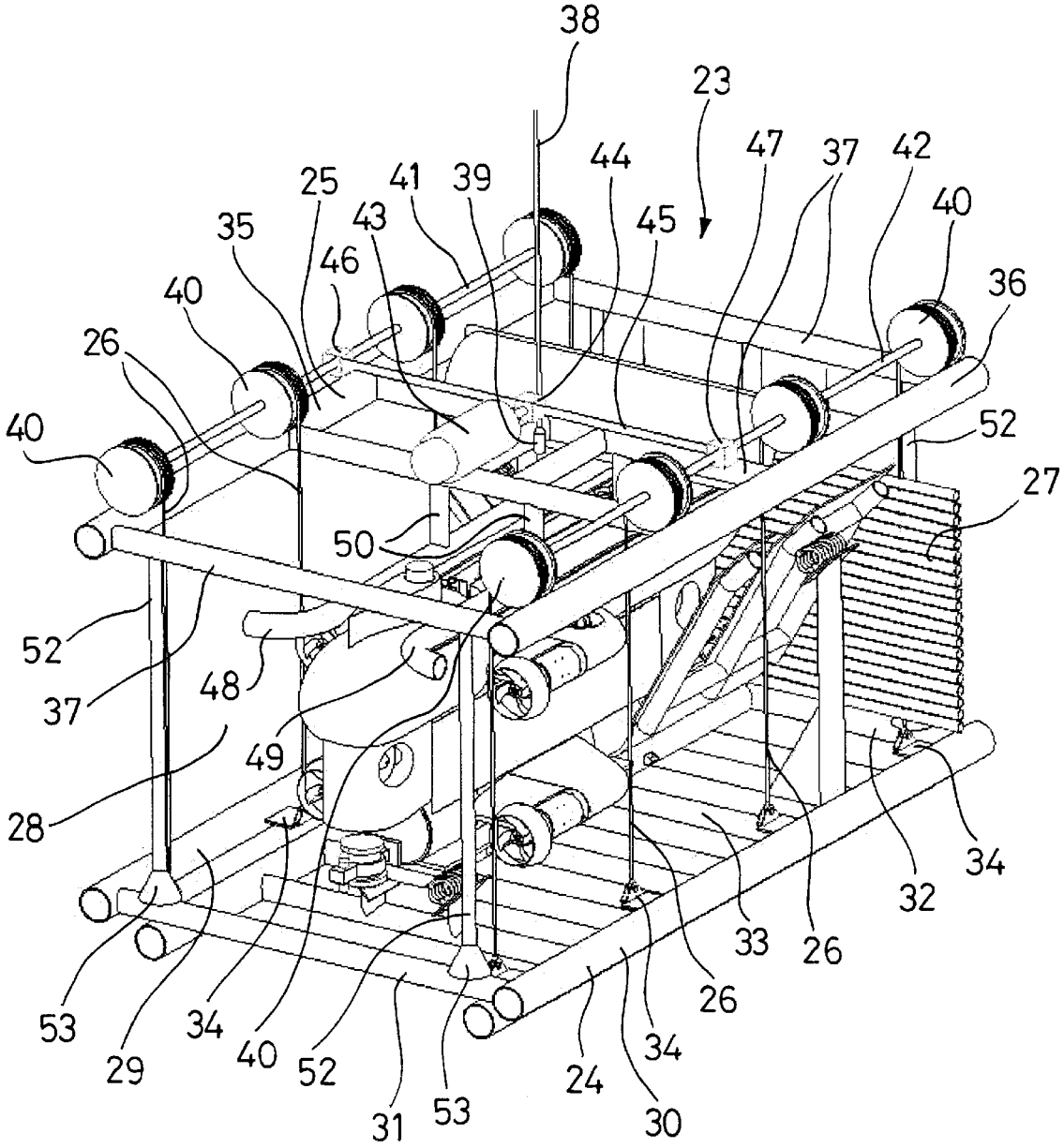
FIG. 2 is a schematic perspective view of a device according to one aspect of the invention in which an underwater vehicle is held.

In FIG. 2, a parallellepipedal cage 23 is formed by a lower chassis 24, an upper chassis 25, a cable bundle 26 and a protective screen 27. The cage 23 comprises an opening 28 allowing the underwater vehicle to enter and exit.

The lower chassis 24, in the form of a tubular frame of rectangular shape, comprises two longitudinal tubes 29, 30 connected by two transverse tubes 31, 32 running at right angles between the ends of the longitudinal tubes 29, 30. The chassis 24 fixed to the tubular framework 2 of the cradle 1, for example by screw-nut systems, can be detached from the tubular framework 2 of the cradle 1. The frame of the lower chassis 24 forms an opening 33 allowing the underwater vehicle 20 to pass through vertically and having at least one dimension that is shorter than a corresponding dimension of the framework 2 of the cradle 1.

Securing yokes 34, formed on the longitudinal tubes 29, 30 towards the inside of the tubular frame formed by the lower chassis 24, can be used to secure cables 24 that form a cable bundle connecting the lower chassis 24 to the upper chassis 25 at right angles to the plane of the framework 2 of the cradle 1.

The upper chassis 25, in the form of a tubular framework similar to the tubular framework 2 of the cradle 1 and comprising two longitudinal tubes 35, 36 and a number of transverse tubes 37, is connected to a boat situated at the surface, and not depicted in the figures, via a flexible connection in the form of a cable 38 fixed to a roughly central part 39 of the upper chassis 25.

Pulleys 40, arranged vertically facing the yokes 34 and rotating as one with longitudinal spindles 41, 42 fixed so that they can rotate to, the corresponding longitudinal tubes 35, 36 by a device which has not been depicted in order to make the drawing clearer, allow the cables 26 to be wound up or unwound. A motor 43 arranged longitudinally on the central part 39 of the upper chassis 25 drives the rotation, via a mechanical angle gearbox 44, of a shaft 45 arranged transversely, provided at its ends with mechanical angle gearboxes 46, 47 for driving the rotation of the spindles 41, 42 respectively. Rotating the motor 43 in a first direction causes the cables 26 to be wound onto the pulleys 40 and causes the lower 24 and upper 25 chassis to be brought closer together. Rotating the motor 43 in the opposite direction to the first direction of rotation causes the cables 25 to be unwound and the lower 24 and upper 25 chassis to be parted.

Figure 3:
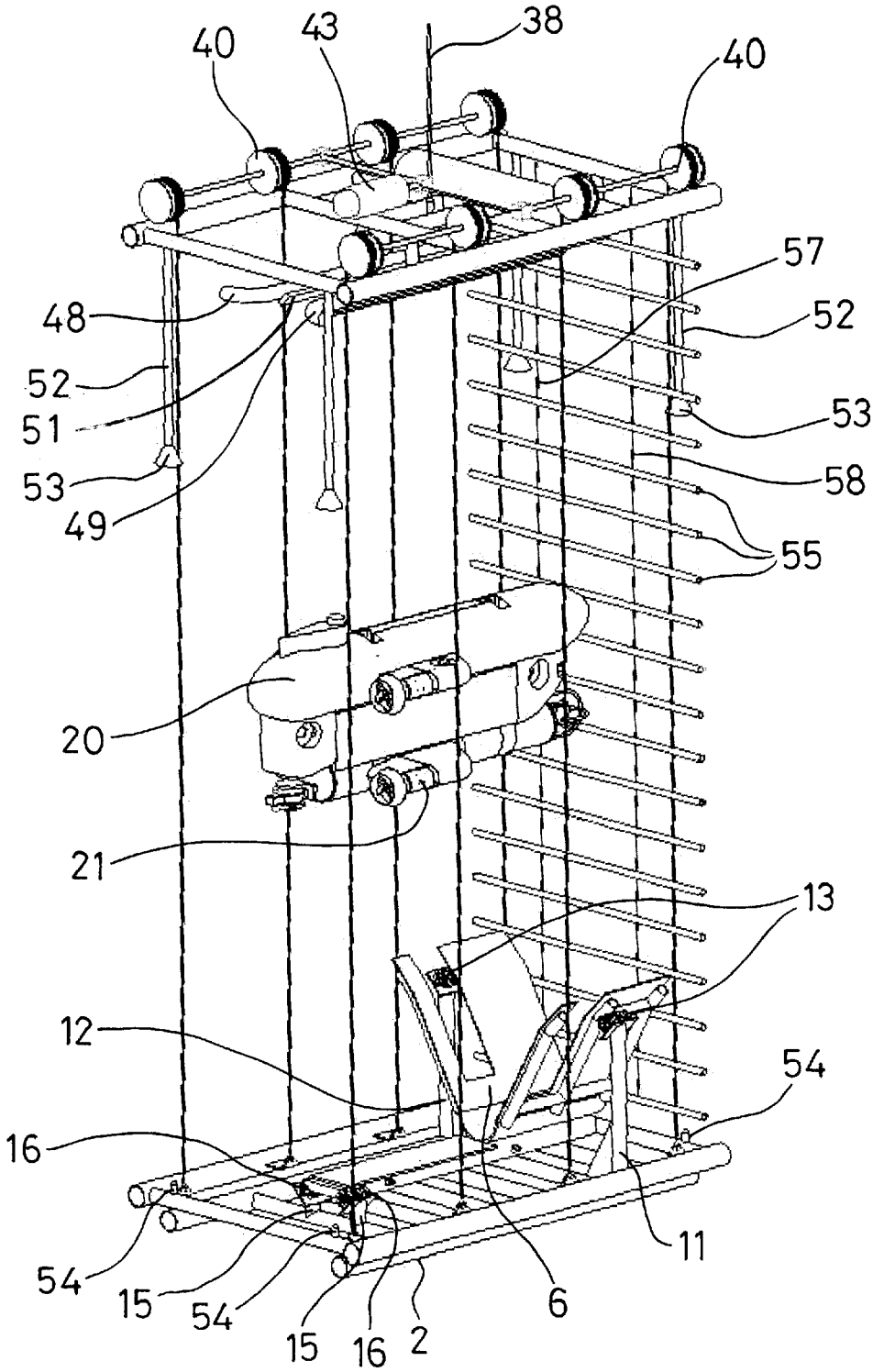
FIG. 3 is a schematic perspective view of a device according to one aspect of the invention situated at a depth under the surface of the sea, in which the lower and upper chassis are distant from one another.

Longitudinal tubular rails 48, 49, the ends of which are outwardly curved, fixed to the upper chassis 25 via connecting tubes 50 arranged vertically, form an upper cradle which comes into contact with the upper surface of the underwater vehicle 20 to hold the latter in place. As can be seen in FIG. 3, the rail portions 48, 49 in contact with the surface of the underwater vehicle 20 may be covered with a flexible coating 51, for example of a material of the elastomeric type, so as to avoid impacts with the surface of the underwater vehicle 20 while the underwater vehicle 20 is being recovered.

Positioning means in the form of tubular supports 52 fixed to the upper chassis 25 drop down vertically towards the transverse tubes 5 situated longitudinally at the ends of the lower chassis 24. The supports 52 are provided at their lower end adjacent to the lower chassis 24 with receiving stops 53 of frustoconical shape which widen towards the bottom. The receiving stops 53 collaborate with studs 54 arranged on the lower chassis 24 and visible in FIG. 3, which project vertically from the said transverse tubes 5. The supports 52 define the minimum vertical distance between the lower and upper chassis so that the underwater vehicle 20 is held by the seating surface 6 and the rails 48, 49 without causing damage to the underwater vehicle 20 as the lower 24 and upper 25 chassis are moved closer together.

The protective screen 27 comprising a number of bars 55 held by two lines 57, 58 deploys in the manner of a blind stacked up between the facing longitudinal ends of the upper 25 and lower 24 chassis so that the bars 55 are contiguous when the lower chassis 24 is in contact with the stops 53.

As illustrated in FIG. 3, unwinding the cables 26 makes it possible to enlarge the said cage 23 in the vertical direction, so as to enlarge the said opening 28 to make the passage of the underwater vehicle 20 easier.

Before launching the underwater vehicle 20, the latter is fixed to the cradle 1 using the straps 19 and 22. The cage 23 is lifted up by a crane present on the boat and not depicted in the figures. As the lower chassis 24 allows the underwater vehicle 20 to pass vertically through the opening 33, the cage 23 is set down on the cradle 1. As the lower chassis 24 has at least one dimension smaller than a corresponding dimension of the framework 2 of the cradle 1, the chassis 24 rests on the framework 2 of the cradle 1. The lower chassis 24 is then fixed manually to the cradle 1 using screw-nut systems.

When the underwater vehicle 20 is launched, the launch and recovery device, as in FIG. 2, is lowered into the water to the desired depth by unwinding the cable 38 using a winch, not depicted in the figures, which controls the rate of descent, and the tension in the cable 38. The rate at which the cable 38 is unwound is monotonous and may be roughly constant. The unwind rate may be several meters per second, for example 3 meters per second, which allows the underwater vehicle to be lowered quickly to the desired depth.

Once the cage 23 has reached the desired depth, the unwinding of the cable 38 is halted, and the unwinding of the cables 26 is commenced so as to increase the distance between the lower and upper chassis so as to release the underwater vehicle 20. The cables 26 are unwound quickly to prevent the underwater vehicle from becoming unbalanced or damaged by the movement of the cage 23 which is due to the heave at the surface. The unwinding of the cables 26 may be accompanied by a winding up of the cable 38 at a rate slower than the rate at which the cables 26 are unwound, simultaneously parting the lower 24 and upper 25 chassis from the underwater vehicle 20. At the same time as the cage 23 is opened up, the underwater vehicle reverses so as to leave the said cage 23 via the opening 28. As a preference, the vertical dimension of the opening 28 of the cage 23 exceeds the amplitude of the vertical movement due to the heave, so that this movement cannot give rise to any impact between the cage 23 and the underwater vehicle 20.

While the underwater vehicle 20 is carrying out its mission, the cage 23 can be raised back on board the boat, or can remain in the water at the depth at which the underwater vehicle 20 is released.

When recovering the underwater vehicle and the cage which has remained or has been lowered back into the water, the cables 26 are unwound so as to obtain an opening 28, the vertical dimension of which is appreciably larger than the amplitude of the vertical movements due to the heave, namely a dimension of the order of 5 m, and which may be as much as 7 m. The underwater vehicle 20, which may comprise guide means, for example acoustic beacons and sonars, which collaborate with guide means belonging to the cage 23, for example sonar reflectors arranged on the elements of the cage 23, is guided or remote-guided from the boat, by transmission means to enter the cage 23 via the opening 28, preferably at the mean depth of the launch and recovery device, given the vertical movements of the said device. As the vertical dimension of the opening 28 is significantly greater than the amplitude of the vertical movements of the cage 23 which are brought about by the heave at the surface, the underwater vehicle 20 does not risk being damaged or unbalanced by knocking into the lower chassis 24 or the upper chassis 25.

Once the underwater vehicle 20 is in position inside the cage 23, in a space situated between the lower chassis 24 and the upper chassis 25, the cables 26 are wound up so as to close the cage again to hold the underwater vehicle between the seating surface 6 of the cradle 1 and the rails 48, 49 of the upper chassis 25. As a preference, the rate at which the cables 26 are wound up is high, to avoid successive impacts due to the relative movements between the underwater vehicle 20 and the seating surface 6 of the cradle 1 as the cradle 1 and the underwater vehicle 20 come into contact, as this could damage the underwater vehicle or unbalance it. For this purpose, use may be made of a rate of winding for the cables 26 which exceeds the maximum rate of vertical travel of the cage 23 due to the heave at the surface. Thus, the cradle 1 always moves vertically upwards relative to the underwater vehicle 20 which is subjected to little or no vertical movement due to the heave at the surface.

The concave wall 8 of the seating surface 6 allows the underwater vehicle 20 to be received on the cradle 1, guiding it to position it in the horizontal plane. The shape of the concave wall 8 which has a vertical plane of symmetry, allows the underwater vehicle to be both centered on the cradle 1 and aligned longitudinally. The absorption stops 13, 16 make it possible to absorb the impacts as the underwater vehicle 20 and the seating surface 6 come into contact so as not to damage the underwater vehicle.

The cables 26 are wound up until the lower chassis 23 comes into contact with the stops 53 whose shape, frustoconical and open at the bottom, guides the studs 54 of the lower chassis 24 so as to position the lower chassis 24 accurately in the horizontal plane with respect to the upper chassis 25. At the same time, the upper part of the underwater vehicle 20 comes into contact with the rails 48, 49 of the upper chassis 25. Thus, when the cage 23 is closed again, the underwater vehicle is held between the cradle 1 and the rails 48, 49 which prevent any movement of the underwater vehicle 20 inside the cage 23. The launch and recovery device can be raised back up to the surface by winding up the cable 38.

The use of a single motor 38 driving a number of pulleys 40 on which the cables 26 are wound using mechanical angle gearboxes 44, 46, 47 and spindles 41, 42, 45 allows the winding-up of all the cables 26 to be synchronized so as not to unbalance the lower chassis 24 and so as to keep the lower chassis 24 roughly in a horizontal plane. The winding-up of the cables 26 can be synchronized in a different way, for example by using sensors and a number of slaved motors.

Furthermore, any connection between the lower chassis and the upper chassis that allows the vertical dimension to be varied will suit. A flexible connection, such as cables, chains or straps is particularly suitable because it can easily be wound up, for example onto pulleys. The use of rams may be envisaged.

When launching and recovering the underwater vehicle, the device according to the invention makes it possible to avoid the use of weighting ballast. What happens is that to accelerate the descent of the underwater vehicle 20 to its working depth and avoid the use of vertical propulsion means, the said underwater vehicle is generally provided with additional weighting ballast known as descent ballast which is jettisoned when the underwater vehicle reaches its working depth. To accelerate the raising of the underwater vehicle, weighting ballast known as raising ballast is jettisoned at the time of raising.

Now, the launch and recovery device allows the underwater vehicle to be launched and recovered directly at the working depth. Thus, during preparation, the underwater vehicle is directly weighted with a view to submerging it to the working depth. The mass of the vehicle at the times of its submersion is thus reduced because it does not contain any descent or raising weighting ballast, which may represent up to 10% of the total weight of the underwater vehicle. The time spent preparing the weighting ballast of the underwater vehicle is reduced. The jettisoning of this weighting ballast is also avoided, which represents a saving and at the same time avoids polluting the sea bed.

In addition, as the underwater vehicle does not use its own vertical propulsion means during the descent, it is possible to make a saving on the energy used by these propulsion means. As the amount of energy on board limits the operating autonomy of the underwater vehicle, an energy saving during the descent or the raising may increase the autonomy of the underwater vehicle or reduce the amount of energy held on board.

When the launch and recovery device is returned to the boat, the said device constitutes a support on which the underwater vehicle can be stored. In addition, as the lower chassis can be detached from the cradle, and as the lower chassis, resting on the framework 2 of the cradle 1 allows the underwater vehicle to pass through it vertically, the cage 23 can be lifted up, without lifting the cradle, as illustrated in FIG. 1. Thus, access can be had to the underwater vehicle 20 to facilitate maintenance or preparation operations. The straps 19 and 22 allow the underwater vehicle 20 to be held more firmly on the cradle 1 in the absence of the upper cradle consisting of the rails 48, 49 of the upper chassis.

On one and the same boat, the device for launching and recovering an underwater vehicle allows the use of a number of underwater vehicles each stored on a cradle, using just the one cage for successively submerging the various underwater vehicles.

The device for launching and recovering an underwater vehicle from a boat in the form of a recovery cage with an opening the vertical dimension of which can be adjusted makes it possible to get around the drawbacks due to the vertical movements of the recovery cage which have as their origin the heave, that is to say the vertical movements of the boat to which the cage is connected and which are due to the swell at the surface of the water.

The device for launching and recovering an underwater vehicle therefore allows an underwater vehicle to be launched and recovered quickly at a depth close to the working depth of the said underwater vehicle, so that more of the on-board energy can be saved for the mission that the underwater vehicle is to carry out, and the use of descent ballast and raising ballast can be avoided. A saving is made in the time preparing the ballast on the underwater vehicle, and a saving in weighting ballast used and jettisoned onto the sea bed is also made.

The device for launching and recovering an underwater vehicle also allows the underwater vehicle to be stored on the boat, while at the same time affording the possibility of easy access to the underwater vehicle with a view to carrying out maintenance and preparation operations for a specific mission.

What is claimed is:

1. Device for launching and recovering an underwater vehicle comprising:

a submersible lower chassis and a submersible upper chassis, said submersible lower chassis and submersible upper chassis forming a submersible assembly, the lower chassis and upper chassis being connected by a flexible connection, at least one motor for rotating a number of pulleys onto which the flexible connection is wound, so that the distance between the upper and lower chassis is adjustable to make it easier for an underwater vehicle to move towards or away from a zone contained between the lower and upper chassis when the assembly is submerged.

2. The device according to claim 1, wherein the flexible connection is a cable bundle.

3. The device according to claim 2, further comprising a device for winding up and unwinding the cable bundle.

4. The device according to claim 1, wherein said device is connected by at least one flexible connection of adjustable length to another device situated at the surface.

5. The device according to claim 1, wherein positioning means are arranged between the upper chassis and the lower chassis.

6. The device according to claim 1, further comprising a lower cradle.

7. The device according to claim 6, wherein the cradle comprises at least one receiving concave wall.

8. The device according to claim 6, wherein the cradle is detachable from the lower chassis.

9. The device according to claim 1, wherein the upper chassis comprises an upper holding cradle.

10. The device according to claim 1, further comprising first guide means structured and arranged to collaborate with second guide means belonging to the underwater vehicle.

11. Method for launching and recovering an underwater vehicle, which comprises:

submerging an upper chassis and lower chassis of a launching and recovery device, the lower and upper chassis being connected by a flexible connection so that the distance between said upper and lower chassis is adjustable, increasing the distance between the upper and lower chassis so as to release the underwater vehicle, and reducing the distance between the upper and lower chassis for recovering the underwater vehicle once said vehicle has moved into a zone contained between the upper and lower chassis.

* * * * *